US011439258B2

(12) United States Patent
Grell

(10) Patent No.: US 11,439,258 B2
(45) Date of Patent: Sep. 13, 2022

(54) BEDLINEN HOLDING SYSTEM AND METHODS OF USE

(71) Applicant: Mathew L. Grell, Norcross, GA (US)

(72) Inventor: Mathew L. Grell, Norcross, GA (US)

( * ) Notice: Subject to any disclaimer, the term of this patent is extended or adjusted under 35 U.S.C. 154(b) by 56 days.

(21) Appl. No.: 17/156,887

(22) Filed: Jan. 25, 2021

(65) Prior Publication Data

US 2021/0251405 A1 Aug. 19, 2021

Related U.S. Application Data

(60) Provisional application No. 62/978,806, filed on Feb. 19, 2020.

(51) Int. Cl.

| | |
|---|---|
| ***A47G 9/04*** | (2006.01) |
| ***A47G 9/02*** | (2006.01) |
| ***A47C 21/02*** | (2006.01) |

(52) U.S. Cl.

CPC ..... *A47G 9/04* (2013.01); *A47C 21/024* (2013.01); *A47G 9/0223* (2013.01); *A47G 9/0246* (2013.01)

(58) Field of Classification Search

CPC ..... A47G 9/0223; A47G 9/0246; A47G 9/04; A47C 21/024

See application file for complete search history.

(56) References Cited

U.S. PATENT DOCUMENTS

| | | | | |
|---|---|---|---|---|
| 2,326,399 | A | 8/1943 | Shields | |
| 3,092,848 | A | 6/1963 | Gronvold | |
| 3,906,559 | A | 9/1975 | Bahr | |
| 4,040,133 | A | 8/1977 | Gilreath | |
| 4,878,258 | A | 11/1989 | Casey | |
| 6,233,764 | B1 * | 5/2001 | Orr | A47G 9/0246 5/692 |
| 6,739,002 | B1 * | 5/2004 | Pannu | A47C 21/022 5/923 |
| 7,007,325 | B1 | 3/2006 | Gomeh | |
| 9,549,625 | B1 * | 1/2017 | Wilkinson | A47G 9/0223 |
| 10,624,475 | B2 * | 4/2020 | Holt | A47G 9/04 |
| 11,071,395 | B1 * | 7/2021 | Sopher | A47C 21/022 |
| 2004/0060113 | A1 | 4/2004 | Lantagne | |
| 2009/0172881 | A1 | 7/2009 | Peterson | |
| 2013/0283528 | A1 * | 10/2013 | Tzur | A47G 9/04 5/498 |
| 2014/0075672 | A1 * | 3/2014 | Marcik | A47G 9/04 5/494 |

(Continued)

*Primary Examiner* — Peter M. Cuomo
*Assistant Examiner* — George Sun
(74) *Attorney, Agent, or Firm* — Mathew L. Grell; Grell & Watson Patent Attorneys LLC

(57) ABSTRACT

A bedlinen holding system and methods of use, for bedlinen material, such as fitted sheet, flat sheet, blankets, comforters, and the like use to make a bed or other sleeping surface, including at least a fitted sheet removeably affixed to a mattress and likely held in place on the mattress by an elastic band sewn into the perimeter edge of the fitted sheet, the fitted sheet having a foot end and a center section of a foot panel, a flat sheet positioned on top of the fitted sheet, the flat sheet having a foot end and a center section, and a connection system configured to removeably affix the foot end and center section of a foot panel of the fitted sheet to the foot end and center section of the flat sheet, and thus to resist or prevent your partner from pulling the sheets and covers off you.

18 Claims, 5 Drawing Sheets

(56) References Cited

U.S. PATENT DOCUMENTS

| | | | | |
|---|---|---|---|---|
| 2014/0130262 | A1* | 5/2014 | Marcik | A47C 21/022<br>5/692 |
| 2017/0318990 | A1* | 11/2017 | David | A47G 9/0261 |
| 2018/0303256 | A1* | 10/2018 | Sturgeon | A47C 21/06 |
| 2020/0245775 | A1* | 8/2020 | Baker | A47G 9/0246 |

* cited by examiner 36
34.1
34.2
50,51,51.1
CL
30,30A,30B
50,52,52.1
32
10
34.4
38
34.3
FE 24.2
40,41
27
SD
22
CL
20
40,42
24.1
24.4
S
FE
28

S
24.3
Top
M
FE
Bottom 36
34.1
34.2
50,51
CL
30,30A,30B
50,52
32
10
34.4
38
34.3
FE 24.2
50,53
27
SD
22
CL
20
50,54
24.1
24.4
FE
28

24.3
80.1
70,71,72
60,61,62
50,53,54
50,51,51.2,51.1
40,41,42
S
90,91,92

BEDLINEN HOLDING SYSTEM AND METHODS OF USE

CROSS-REFERENCE TO RELATED APPLICATIONS

To the full extent permitted by law, the present United States Non-provisional Patent Application hereby claims priority to and the full benefit of, U.S. Provisional Application No. 62/978,806, filed on Feb. 19, 2020, entitled "Bed Sheets Holding System and Methods of Use", which is incorporated by reference herein in its entirety.

FIELD OF THE DISCLOSURE

The present disclosure is directed to bedlinen and methods of use thereof. More specifically, the present disclosure is directed to a system to hold bedlinen in place on a mattress.

BACKGROUND

Various approaches have been utilized to keep the fitted or bottom sheet fitted to the mattress or sleeping surface, such as elastic banding, straps, buckles, clasps, fold under sections, hook and loop, some have fasteners attached to the bed to connect the fitted sheet to the mattress. Other approaches have been utilized to keep the flat or top sheet fitted to the mattress or sleeping surface, such as elastic banding, sewing, straps, buckles, clasps, fold under sections, hook and loop, some have fasteners attached to the bed to connect the flat sheet to the mattress.

One disadvantage or drawback to these approaches is that, existing sheets and blankets are easily pulled askew on the mattress and partners may pull the sheet and blanket off of their partner. Moreover, this misalignment makes for extra work when making the bed in the morning. Another disadvantage or drawback to these approaches is that, existing sheets and blankets are difficult to orient to the bed, such as which end is the foot and which end is for the head when attaching the sheets to the bed. Another disadvantage or drawback to these approaches is that, hook and loop is unpleasant to the touch of a sleeper. Another disadvantage or drawback to these approaches is that, any additional hardware added to the bedding may make a racket while in the dryer. Another disadvantage or drawback to these approaches is that, if the fitted and flat sheet or other linens are sewn together, they are difficult to launder since they will twist and bunch together during either the wash or dry cycle. Another disadvantage or drawback to these approaches is that, no specialized hardware is needed to be affixed to the mattress.

Therefore, it is readily apparent that there is a recognizable unmet need for a bedlinen holding system and methods of use that may be configured to address at least some aspects of the problems discussed above common to bedding and sleep conditions.

SUMMARY

Briefly described, in an example embodiment, the present disclosure may overcome the above-mentioned disadvantages and may meet the recognized need for a bedlinen holding system and methods of use, for bedlinen material, such as fitted sheet, flat sheet, blankets, comforters, and the like use to make a bed or other sleeping surface, including at least a fitted sheet removeably affixed to a mattress and likely held in place on the mattress by an elastic band sewn into the perimeter edge of the fitted sheet, the fitted sheet having a foot end and a center section of a foot panel, a flat sheet positioned on top of the fitted sheet, the flat sheet having a foot end and a center section, and a connection system configured to removeably affix the foot end and center section of a foot panel of the fitted sheet to the foot end and center section of the flat sheet, and thus to resist or prevent your partner from pulling the sheets and covers off you and keeping the flat sheet oriented and in a stay in place position making it easy to make the bed in the morning.

Accordingly, in one aspect, the present disclosure the bedlinen holding system and methods of use may be to provide a set of straps affixed the foot end and a center section of a foot panel of the fitted sheet.

Accordingly, in another aspect, the present disclosure may include a set of apertures positioned in the foot end and a center section of the flat sheet to receive therethrough one of the adjacent set of straps affixed to the foot end and a center section of a foot panel of the fitted sheet.

Accordingly, in another aspect, the present disclosure may include variety connection system configured to removeably affix the foot end and center section of a foot panel of the fitted sheet to the foot end and center section of the flat sheet.

Accordingly, in another aspect, the present disclosure may include any variety or count of connection systems configured to removeably affix the foot end and center section of a foot panel of the fitted sheet to the foot end and center section of the flat sheet.

Accordingly, in another aspect, the present disclosure may include any and all dimensional relationships, to include variations in size, material, shape, form, position, function and manner of operation, assembly and use, are intended to be encompassed by the present disclosure.

In an exemplary embodiment, a bedlinen connection system for a mattress with a centerline and a foot end, the system including a fitted sheet to fit the mattress having a fitted sheet center section of a foot end panel centered proximate the centerline, the fitted sheet center section configured having two or more straps, each of the two or more straps having one end portion affixed to the foot end panel and a other end portion extends above the top section and a flat sheet to lay on the fitted sheet having a flat sheet center section of a foot edge panel centered proximate the centerline, the flat sheet center section configured having two or more flat sheet grommets, each of the two or more flat sheet grommets to receive the other end of one of the two or more straps to connect the flat sheet to the fitted sheet.

In another exemplary embodiment, a bedlinen connection system for a mattress with a centerline and a foot end, the system including a fitted sheet to fit the mattress having a fitted sheet center section of a foot end panel centered proximate the centerline, the fitted sheet center section having two or more fitted sheet grommets, each of the two or more flat sheet grommets to receive the other end of one of the two or more straps to connect the flat sheet to the fitted sheet, a flat sheet to lay on the fitted sheet having a flat sheet center section of a foot edge panel centered proximate the centerline, the flat sheet center section configured having two or more flat sheet grommets, each of the two or more flat sheet grommets to receive the other end of one of the two or more straps to connect the flat sheet to the fitted sheet and two or more straps, each of the two or more straps having one end portion configured having a stop device and a other end portion extends through one of the two or more fitted sheet grommets and one of the two or more flat sheet grommets to connect the flat sheet to the fitted sheet.

In another exemplary embodiment, a bedlinen connection system for a mattress with a centerline and a foot end, the system including a fitted sheet to fit the mattress having a fitted sheet center section of a foot end panel centered proximate the centerline, a flat sheet to lay on the fitted sheet having a flat sheet center section of a foot edge panel centered proximate the centerline and an attachment device configured to attach the fitted sheet center section to the flat sheet center section to hold in place the flat sheet to the fitted sheet at the foot end.

A feature of the present disclosure is its ability to provide stay in place sheet technology that configures the sheets with the fitted sheet and flat sheet connected together at the foot of the fitted sheet and in a center section to resist or prevent your partner from pulling the sheets and covers off you.

Another feature of the present disclosure is its ability to prevent your partner from performing the tuck and roll or hook a knee or elbow to steal the covers and force the other to wake up coverless and cold.

Another feature of the present disclosure is its ability to easily make the bed in the morning, since the flat sheet is affixed to the fitted sheet both stay in place throughout the night.

Another feature of the present disclosure is its ability to enable each side to have an unconnected bottom left and right section at the foot of the bed to allow your feet to escape from the top sheet and covers to breath and regulate temperature.

Another feature of the present disclosure is its ability to enable the fitted sheet and flat sheet and blankets to be separated for laundry, otherwise the fitted sheet and flat sheet tend to twist and wrap into a snake preventing cleaning and drying of the bedlinens.

Another feature of the present disclosure is its ability to prevent the feeling of a sleeping bag when the entire end edge of both fitted sheet and flat sheet are sewn together.

These and other features of the bedlinen holding system and methods of use will become more apparent to one skilled in the art from the prior Summary and following Brief Description of the Drawings, Detailed Description of exemplary embodiments thereof, and Claims when read in light of the accompanying Drawings or Figures.

BRIEF DESCRIPTION OF THE DRAWINGS

The present bedlinen holding system and methods of use of use will be better understood by reading the Detailed Description of the Preferred and Selected Alternate Embodiments with reference to the accompanying drawing Figures, in which like reference numerals denote similar structure and refer to like elements throughout, and in which.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

In describing the exemplary embodiments of the present disclosure, as illustrated in figures specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Figures 1, 2, 3:
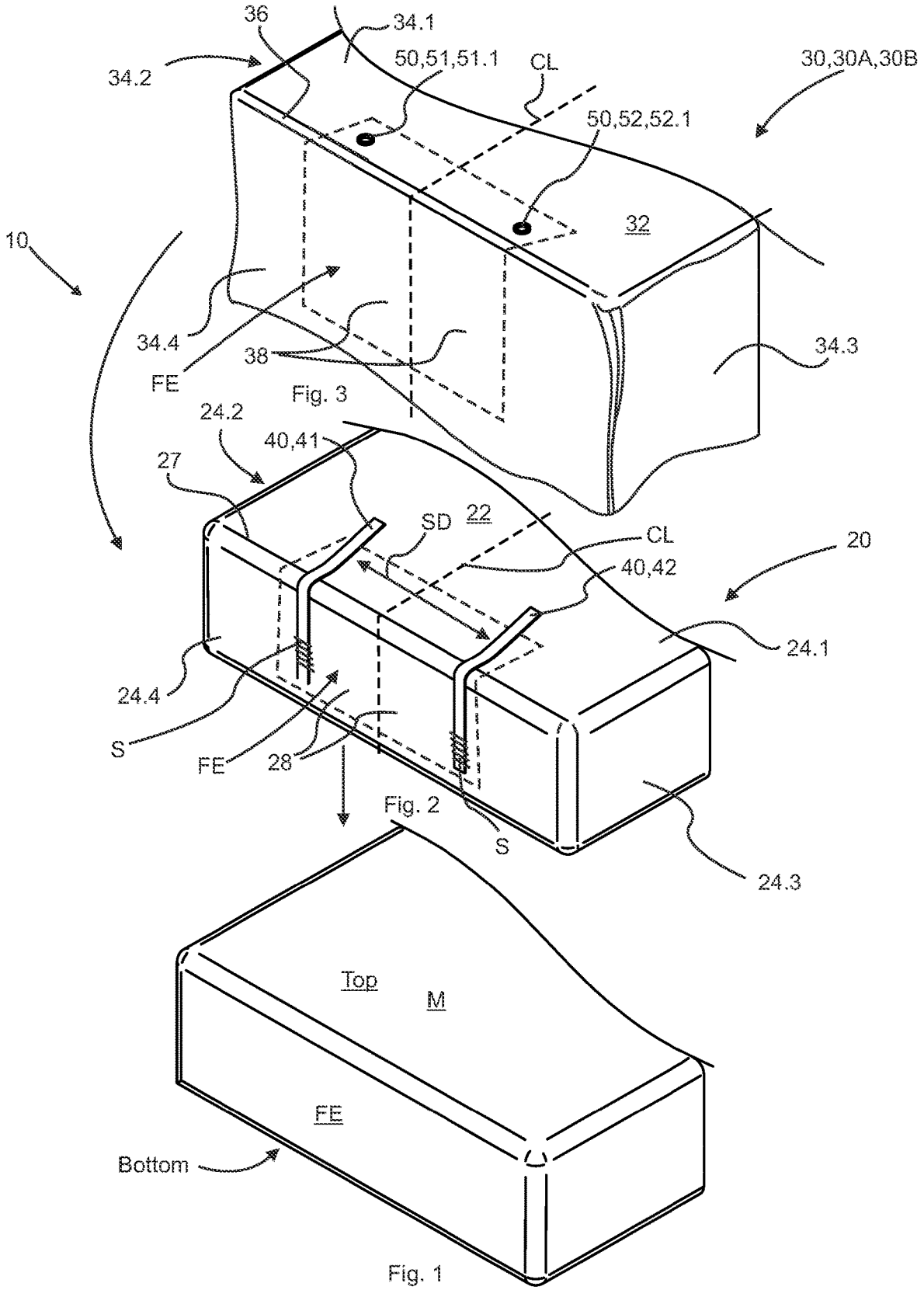
FIG. 1 is a perspective view of a standard mattress or other sleeping surface.
FIG. 2 is a perspective view of the base bedlinens of a fitted sheet positioned above a standard mattress, shown with connection system according to select embodiments of the instant disclosure.
FIG. 3 is a perspective view of the base bedlinens of a flat sheet positioned above a fitted sheet and standard mattress to show order of assembly, shown with connection system according to select embodiments of the instant disclosure.
Figure 4:
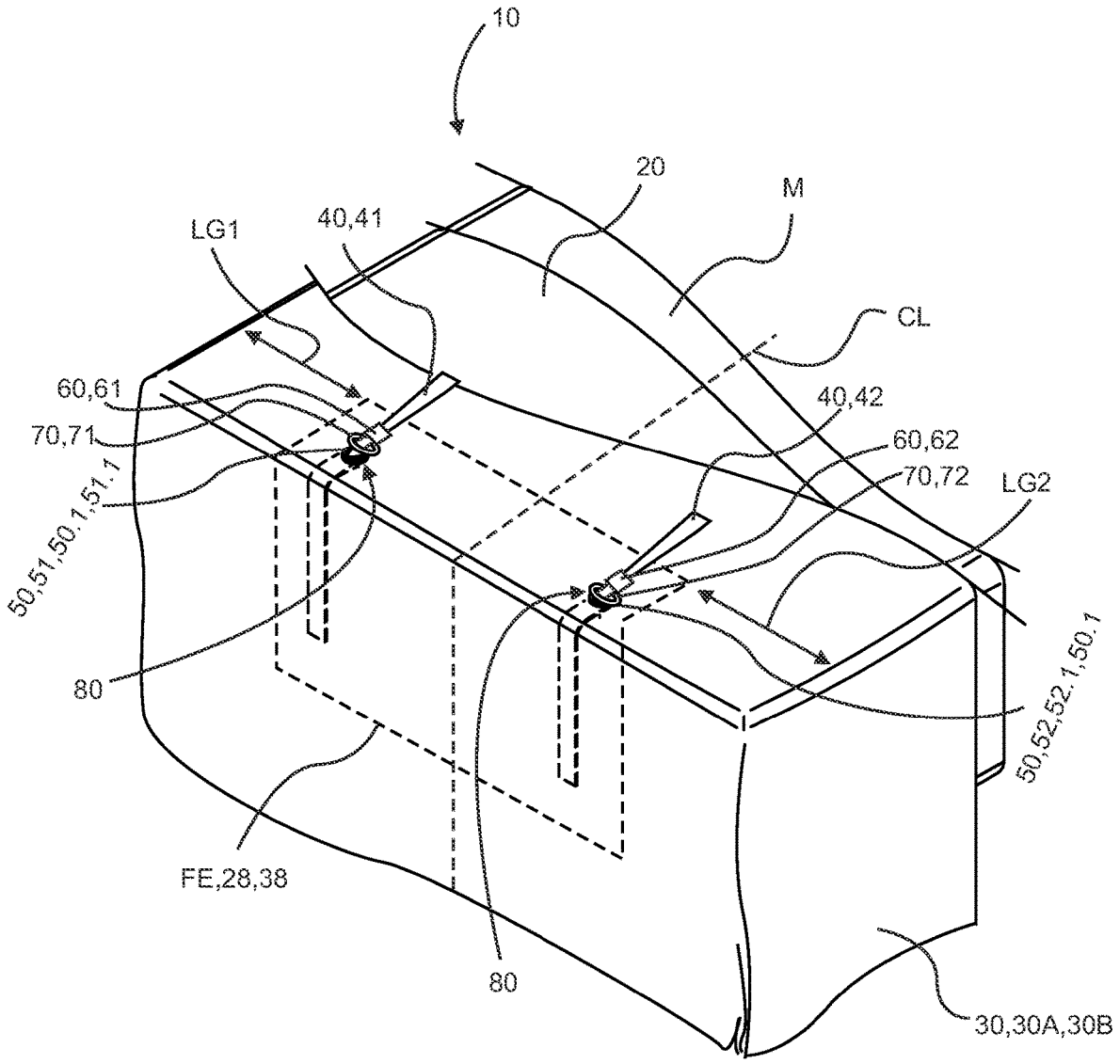
FIG. 4 is a perspective view of the base bedlinens of a mattress, fitted sheet, and flat sheet assembled, shown with connection system according to select embodiments of the instant disclosure.

Referring now to FIGS. 1, 2, 3 and 4, by way of example, and not limitation, there is illustrated an example embodiment of base bedlinens 10 with a bedlinen connection system for mattress M. Bedlinens 10 may include fitted sheet 20, flat sheet 30, blanket 30A, comforter 30B. As shown in FIGS. 2 and 4 fitted sheet 20 may include a sheet configured to fit a rounded edge rectangular mattress having a rectangular top section 22 with upper perimeter edge 27, four side rectangular panels, such as head or first side rectangular panel 24.1, left or second side rectangular panel 24.2, right or third side rectangular panel 24.3, and foot end or fourth side rectangular panel 24.4. Fitted sheet 20 may further include elastic band 26 sewn to lower perimeter edge 25 of fitted sheet 20. Moreover, fitted sheet 20 may include fitted sheet center section of foot or fourth side rectangular panel 24.4 and foot end FE of top section 22 centered about, around or proximate centerline CL of fitted sheet 20. Foot end panel 28 includes foot end or fourth side rectangular panel 24.4 and foot end of top section 22 centered about, around or proximate centerline CL of fitted sheet 20 having a reduced arear smaller than or within fourth side rectangular panel 24.4. Fitted sheet 20 may be configured to snuggly fit thereon mattress M.

Furthermore, as shown in FIGS. 3 and 4 flat sheet 30 may include a sheet configured to lie or rest thereon fitted sheet 20. Flat sheet 30 may include top section 32 configured as a four sided rectangle, such as head or first edge panel 34.1, left or second edge panel 34.2, right or third edge panel 34.3, and foot or fourth edge panel 34.4 (foot edge panel). Flat sheet 30 may further include center section of foot or fourth edge panel 34.4 and foot end FE of top section 32 centered about, around or proximate centerline CL of flat sheet 30. Flat sheet center section 38 includes foot or fourth edge panel 34.4 and foot end of top section 32 centered about, around or proximate centerline CL of flat sheet 20 having a reduced arear smaller than or within foot or fourth edge panel 34.4. Fitted sheet 30 may further include a bend, such as flat sheet bend 36 proximate foot or fourth edge panel 34.4 configured to fit fitted sheet 30 thereto mattress M.

It is contemplated herein that a blanket 30A or comforter 30B having a configuration similar to flat sheet 30 may be positioned thereon flat sheet 30.

Referring again to FIGS. 2 and 4, by way of example, and not limitation, there is illustrated an example embodiment of bedlinens 10. Fitted sheet 20 may be configured having center section 28 of foot or fourth side rectangular panel 24.4 and foot end FE of top section 22 centered about, around or proximate centerline CL of fitted sheet 20 having a plurality of or two or more elongated members 40, such as straps, first strap 41 and second strap 42 with one end portion/section connected, affixed, sewn S, or releasably connected thereto fourth side rectangular panel 24.4 and/or foot end FE of top section 22 of fitted sheet 20 along a portion or section of first strap 41 and second strap 42 with the remainder or other end portion/section of first strap 41 and second strap 42 extends(ing) preferably vertically or parallel (side-by-side) about centerline CL from approximately perimeter edge 25 to above upper perimeter edge 27 or top section 22 of fitted sheet 20.

It is recognized herein that elongated members 40, such as first strap 41 and second strap 42 may be affixed to fitted sheet 20 by a variety of methods, sewn, glued, buttoned, hook and loop, and the like, connected C. Moreover, first strap 41 and second strap 42 may have plastic or melted ends to prevent fraying of strap ends and simplify inserting strap ends into a hole.

It is further recognized herein that elongated members 40 may be positioned anywhere on fourth side rectangular panel 24.4 or top section 22, and preferably thereon center section 28 of foot end FE about a centerline CL.

It is recognized herein that sewn S may include fabric glue, adhesive, snaps, button, zipper, hook and loop and other releasably or fixed ways to connect fabric.

Referring again to FIGS. 3 and 4, by way of example, and not limitation, there is illustrated an example embodiment of bedlinens 10. Flat sheet 30 may be configured having flat sheet center section 38 of foot or fourth edge panel 34.4 and foot end FE of top section 32 centered about, around or proximate centerline CL of flat sheet 30 having a plurality of or two or more eyelets, holes, apertures, flat sheet grommets 50 therethrough, such as first grommet 51 and second grommet 52 connected, affixed, sewn, or releasably connected thereto flat sheet center section 38 of foot or fourth edge panel 34.4 and foot end FE of top section 32 centered about, around or proximate centerline CL to receive the other end of first strap 41 and second strap 42 to releasably connect fitted sheet 20 thereto flat sheet 30 to each other at the foot of the bed. Flat sheet 30 may further include a bend, such as flat sheet bend 36 proximate foot or fourth edge panel 34.4 and foot end FE of top section 32 configured to fit flat sheet 30 thereto mattress M.

It is recognized herein that plurality of holes, apertures, grommets 50 may be affixed to flat sheet 30 by a variety of methods, sewn, glued, buttoned, hook and loop, press fitted and the like.

It is further recognized herein that plurality of holes, apertures, grommets 50 may be positioned anywhere on fourth edge panel 34.4 or top section 22, and preferably therein flat sheet center section 38 of foot end FE about a centerline CL, provide such positioning is adjacent first strap 41 and second strap 42, respectively.

Referring again to FIG. 4, by way of example, and not limitation, there is illustrated an example embodiment of bedlinens 10 having connection system 80. Connection system 80 may be configured having first grommet 51 and second grommet 52 of flat sheet 30 and first strap 41 and second strap 42 spaced apart or separated a distance SD, where first grommet 51 and second grommet 52 is positioned or aligned above first strap 41 and second strap 42 to receive first strap 41 and second strap 42 therethrough first grommet 51 and second grommet 52 to secure or hold in place flat sheet 30 thereto fitted sheet 20 at the foot of the bed.

It is recognized herein that connection system 80 may be positioned anywhere on fourth side rectangular panel 24.4 or foot end of top section 22, and preferably therein center section 28 of foot end FE about a centerline CL.

It is recognized herein that connection system 80 may be positioned anywhere on fourth edge panel 34.4 or top section 22 or foot end of top section 32, and preferably therein flat sheet center section 38 of foot end FE about a centerline CL.

Moreover, connection system 80 may be configured where each of first strap 41 and second strap 42 may be configured with a plurality of or two or more cinch device or cinch device or holding device 60, such as first cinch device 61 and second cinch device 62. First cinch device 61 and second cinch device 62 may be configured to hold or secure in place first grommet 51 and second grommet 52 of flat sheet 30 thereto first strap 41 and second strap 42 of fitted sheet 20, or hold grommet 50 to strap 30, or hold in place flat sheet 30 thereto fitted sheet 20 at the foot of the bed.

Furthermore, connection system 80 may be configured where each of first strap 41 and second strap 42 may be configured with a plurality of or two or more washers 70, such as first washer 71 and second washer 72. First washer 71 and second washer 72 may be configured to distribute the load from first cord lock 61 and second cinch device 62 over a larger area to hold in place first grommet 51 and second grommet 52 of flat sheet 30 thereto first strap 41 and second strap 42 of fitted sheet 20, or hold in place flat sheet 30 thereto fitted sheet 20.

It is further contemplated herein that connection system 80 may be configured where a half bow knot or knot, nodule cords (like no tie shoe laces) pulled through eyelets may be fastened after holding device 60 to provide extra stay in place holding power to prevent slippage, to hold in place first grommet 51 and second grommet 52 of flat sheet 30 thereto first grommet 51 and second grommet 52 fitted sheet 20, or hold in place flat sheet 30 thereto fitted sheet 20.

It is recognized herein that connection system 80 may be configured having a simplified holding device 60 or cinch device, such as half bow knot or other knot to hold in place first grommet 51 and second grommet 52 of flat sheet 30 thereto first grommet 51 and second grommet 52 fitted sheet 20, or hold in place flat sheet 30 thereto fitted sheet 20 at the foot of the bed.

Referring again to FIGS. 3 and 4, by way of example, and not limitation, there is illustrated an example embodiment of bedlinens 10. Additional layering may include comforter 30B, duvet 30B, foot warmer blanket 30B, and blanket 30A (collectively blanket 30A) may be configured having blanket center section 38 of foot or fourth edge panel 34.4 and foot end FE of top section 32 centered about, around or proximate centerline CL of blanket 30A having a plurality of or two or more holes, apertures, blanket grommets 50.1 therethrough, such as first blanket grommet 51.1 and second blanket grommet 52.1 connected, affixed, sewn, or releasably connected thereto blanket center section 38 of foot or fourth edge panel 34.4 and foot end FE of top section 32 centered about, around or proximate centerline CL to receive first strap 41 and second strap 42 to releasably connect blanket 30A thereto flat sheet 30 and fitted sheet 20 to each other at the foot of the bed. Blanket 30A may further include a bend, such as blanket bend 36 proximate foot or fourth edge panel 34.4 and foot end FE of top section 32 configured to fit blanket 30A thereto flat sheet 30 and mattress M.

It is recognized herein that plurality of holes, apertures, grommets 50.1 may be affixed to blanket 30A by a variety of methods, sewn, glued, buttoned, hook and loop, press fitted and the like.

It is further recognized herein that plurality of holes, apertures, grommets 50.1 may be positioned anywhere on fourth side rectangular panel 24.4 or top section 22, and preferably therein blanket center section 28 of foot end FE about a centerline CL, provide such positioning is adjacent first strap 41 and second strap 42, respectively.

Referring again to FIG. 4, by way of example, and not limitation, there is illustrated an example embodiment of bedlinens 10 having connection system 80. Connection system 80 may be configured having first grommet 51 and second grommet 52 of flat sheet 30, and first grommet 51.1 and second grommet 52.1 of blanket 30A, and first strap 41 and second strap 42 spaced apart or separated a distance SD, where both first grommet 51 and second grommet 52 of flat sheet 30, and first grommet 51.1 and second grommet 52.1 of blanket 30A are positioned or aligned above first strap 41 and second strap 42 to receive first strap 41 and second strap 42 therethrough first grommet 51 and second grommet 52 of flat sheet 30 and first grommet 51.1 and second grommet 52.1 of blanket 30A to secure or hold in place flat sheet 30 and blanket 30A thereto fitted sheet 20 at the foot of the bed.

It is recognized herein that connection system 80 may be positioned anywhere on fourth side rectangular panel 24.4 or top section 22, and preferably therein center section 28 of foot end FE about a centerline CL.

It is recognized herein that connection system 80 may include holding device 60 or cinch device, or simplified holding device 60, half bow knot or other knot, to hold in place first grommet 51 and second grommet 52 of flat sheet 30, and first grommet 51.1 and second grommet 52.1 of blanket 30A or hold in place flat sheet 30 and blanket 30A thereto fitted sheet 20 at the foot of the bed.

Figure 5:
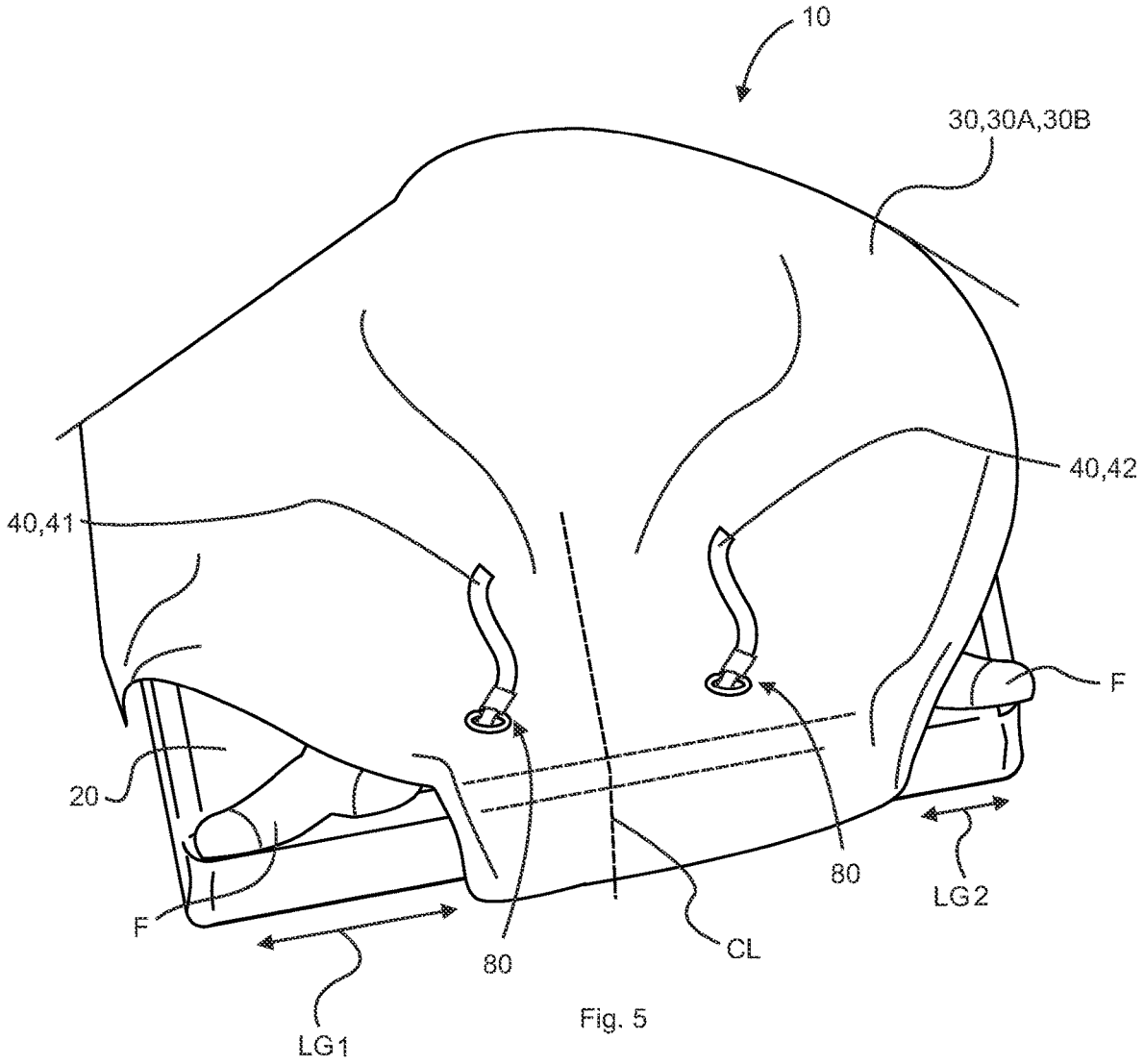
FIG. 5 is a perspective view of a standard mattress with bedlinens, connection system of FIG. 4, shown with foot exits or gaps.
Figures 6A, 6B, 6C:
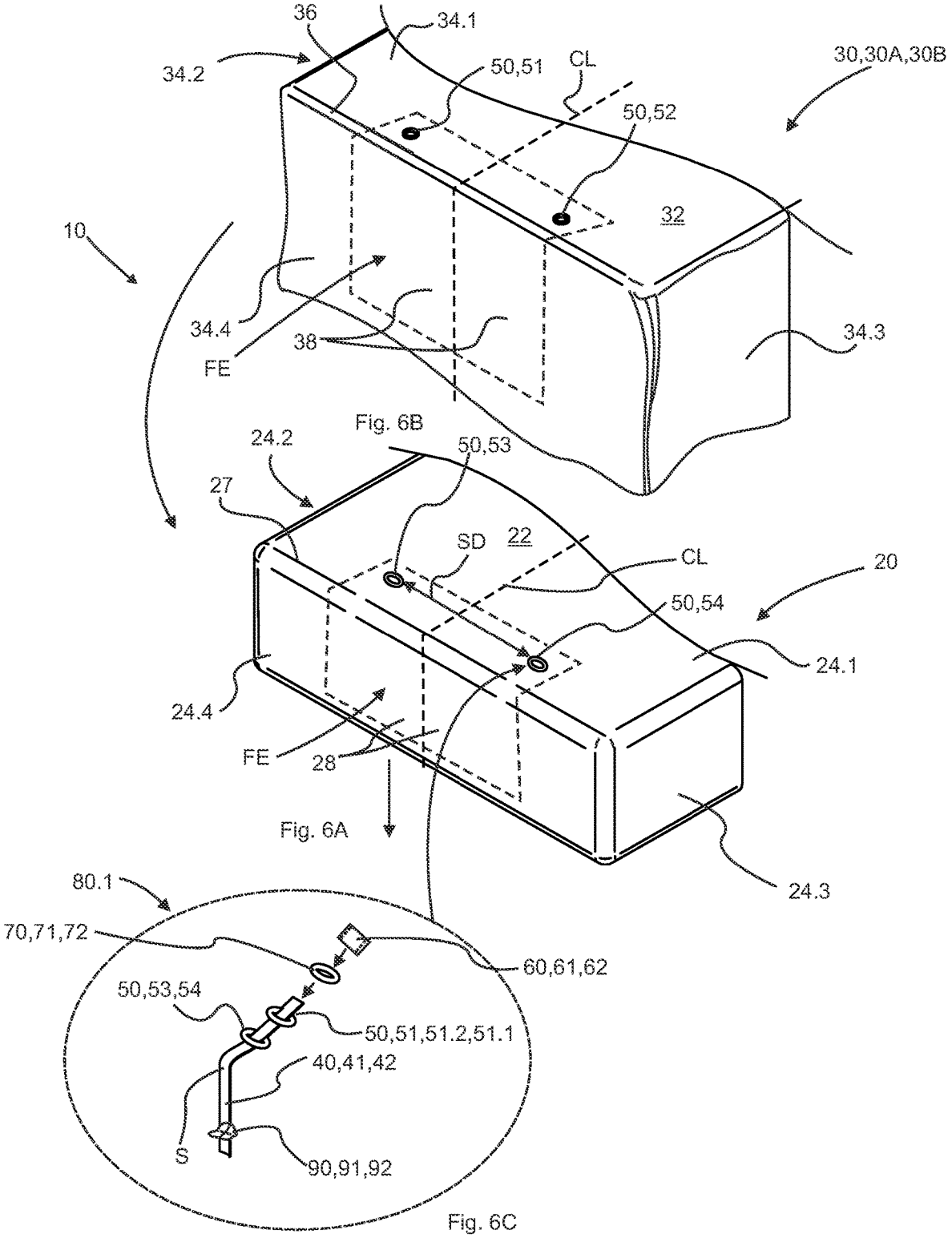
FIG. 6A is a perspective view of the base bedlinens of a fitted sheet positioned above a standard mattress, shown with alternate connection system according to select embodiments of the instant disclosure.
FIG. 6B is a perspective view of the base bedlinens of a flat sheet positioned above a fitted sheet and standard mattress to show order of assembly, shown with alternate connection system according to select embodiments of the instant disclosure.
FIG. 6C is a perspective view of the alternate connection system according to select embodiments of the instant disclosure.

Referring now to FIG. 5, by way of example, and not limitation, there is illustrated an example embodiment of bedlinens 10 having connection system 80. Connection system 80 may be configured having leg exits via gap or lower extremity gap, such as first foot exit LG1 and second foot exit LG2 to enable user or user's foot (one or both sleepers) leg or foot F to escape from flat sheet 30 and covers to breathe and regulate temperature.

It is recognized herein that first foot exit LG1 and second foot exit LG2 are preferably positioned on opposite sides of center section 28 of foot or fourth side rectangular panel 24.4 and foot end FE of top section 22 centered about, around or proximate centerline CL as an unconnected bottom left and right section adjacent or outside of separated distance SD to enable foot or leg exits via gap or lower extremity gap, such as first foot exit LG1 and second foot exit LG2 to enable user or user's (one or both sleepers) leg or foot F to escape from the top sheet 30 and covers to breath and regulate temperature.

It is recognized herein that first foot exit LG1 and second foot exit LG2 are preferably positioned on opposite sides of flat sheet center section 38 of foot or fourth edge panel 34.4 and foot end FE of top section 32 centered about, around or proximate centerline CL as an unconnected bottom left and right section adjacent or outside of separated distance SD to enable foot or leg exits via gap or lower extremity gap, such as first foot exit LG1 and second foot exit LG2 to enable user or user's (one or both sleepers) leg or foot F to escape from the top sheet 30 and covers to breath and regulate temperature.

Referring now to FIGS. 1, 2, and 6A, 6B, 6C by way of example, and not limitation, there is illustrated an example embodiment of bedlinens 10 with an alternate connection system 80.1. Fitted sheet 20 may be configured having center section 28 of foot or fourth side rectangular panel 24.4 and foot end FE of top section 22 centered about, around or proximate centerline CL of fitted sheet 20 having a plurality of holes, apertures, fitted sheet grommets 50.1 therethrough, such as third grommet 53 and fourth grommet 54 connected, affixed, sewn, or releasably connected thereto center section 28 of foot or fourth side rectangular panel 24.4 and foot end FE of top section 22 centered about, around or proximate centerline CL. Flat sheet 30 may be configured having flat sheet center section 38 of foot or fourth edge panel 34.4 and foot end FE of top section 32 centered about, around or proximate centerline CL of flat sheet 30 having a plurality of holes, apertures, grommets 50 therethrough, such as first grommet 51 and second grommet 52 connected, affixed, sewn, or releasably connected thereto flat sheet center section 38 of foot or fourth edge panel 34.4 and foot end FE of top section 32 centered about, around or proximate centerline CL. Each pair of grommets may be aligned over the other, such as first grommet 51 and third grommet 53, and second grommet 52 and fourth grommet 54 to receive one of first strap 41 and second strap 42. Each of first strap 41 and second strap 42 may be configured with a plurality of or two or more stop device 90 on one end, such as first stop device 91 and second stop device 92. First stop device 91 and second stop device 92 may be positioned on the underside of fitted sheet 20 and configured to prevent first strap 41 and second strap 42 from being pulled through grommets 50.1 therethrough, such as third grommet 53 and fourth grommet 54 and secure first strap 41 and second strap 42 to fitted sheet 20.

Again, cinch device or holding device 60, such as first cinch device 61 and second cinch device 62 may be configured to hold in place first grommet 51 and second grommet 52 of flat sheet 30 and/or blanket 30A thereto first strap 41 and second strap 42 of fitted sheet 20, or hold in place flat sheet 30 and/or blanket 30A thereto fitted sheet 20 at the foot of the bed.

It is recognized herein that connection system 80.1 may be positioned anywhere on fourth side rectangular panel 24.4 or top section 22, and preferably therein center section 28 of foot end FE about a centerline CL.

It is further recognized herein that stop device 90 may include half bow knot or knot, washer with one end of strap 40 fed therethrough, or other like stop device to prevent first strap 41 and second strap 42 from being pulled through grommets 50.1, such as third grommet 53 and fourth grommet 54. and secure first strap 41 and second strap 42 to fitted sheet 20 to hold in place first grommet 51 and second grommet 52 of flat sheet 30 and/or blanket 30A thereto first strap 41 and second strap 42 and to fitted sheet 20 via first strap 41 and second strap 42 through grommets 50.1, such as third grommet 53 and fourth grommet 54 to hold in place flat sheet 30 and/or blanket 30A thereto fitted sheet 20 at the foot of the bed.

It is contemplated herein that first strap 41 and second strap 42 may be affixed to mattress M at the foot end FE or to top at foot end FE or bottom at foot end FE (foot end panel of mattress M about a centerline CL) and each pair of grommets may be aligned over the other, such as first grommet 51 and third grommet 53, and second grommet 52 and fourth grommet 54 to receive one of first strap 41 and second strap 42 to hold in place flat sheet 30 and/or blanket 30A thereto fitted sheet 20 at the foot of the bed.

Figure 7:
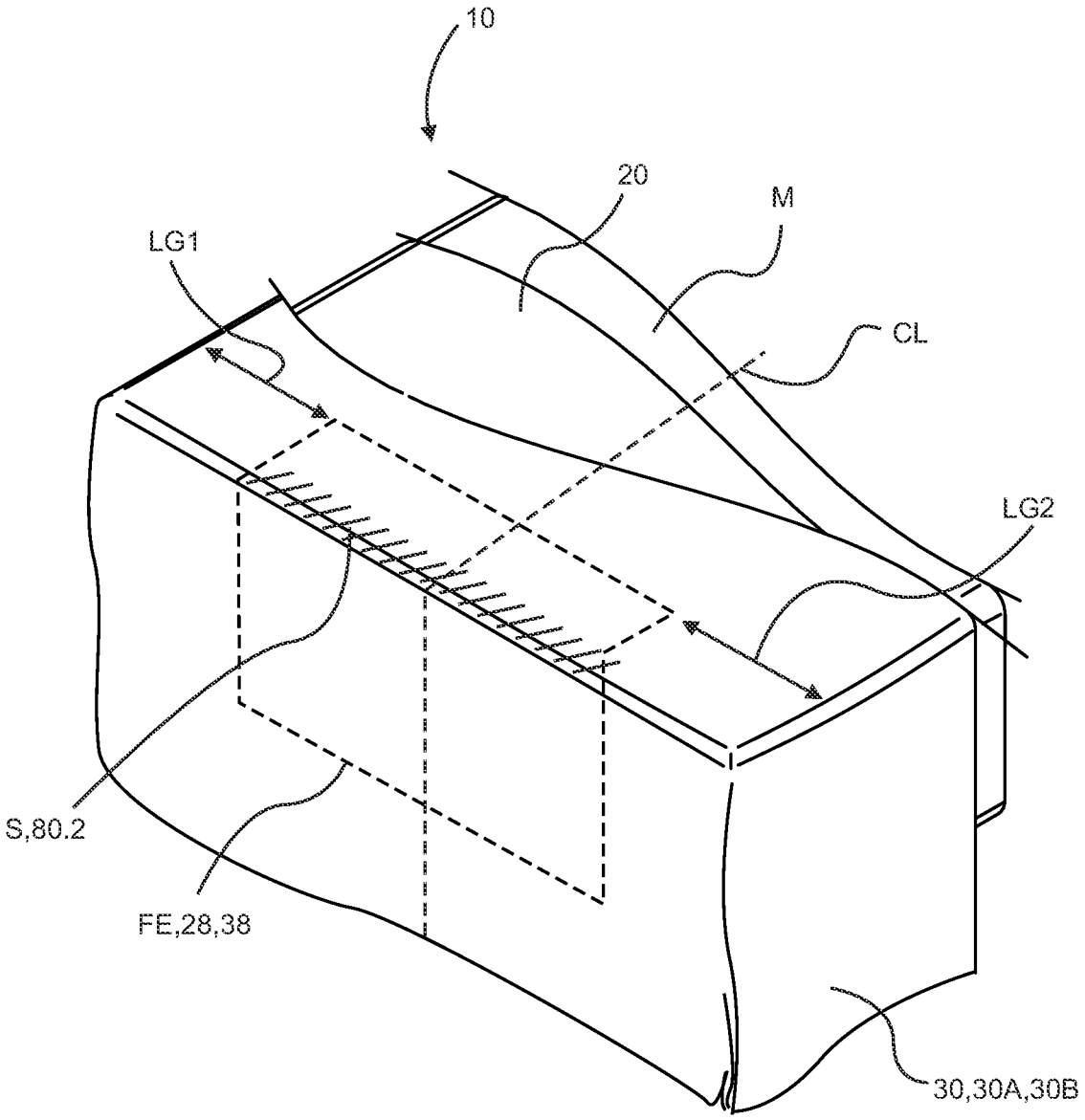
FIG. 7 is a perspective view of the base bedlinens of a mattress, fitted sheet, and flat sheet assembled, shown with alternate connection system according to select embodiments of the instant disclosure.

Referring now to FIG. 7, by way of example, and not limitation, there is illustrated an example embodiment of bedlinens 10 with an alternate connection system 80, attachment system 80.2. Fitted sheet 20 may be configured having fitted sheet center section of foot or fourth side rectangular panel 24.4 and foot end FE of top section 22 centered about, around or proximate centerline CL and flat sheet 30 may be configured having flat sheet center section 38 of foot or fourth edge panel 34.4 and foot end FE of top section 32 centered about, around or proximate centerline CL. Attachment system 80.2 may be configured where flat sheet 30 may be connected, attach, affixed, or sewn S (attachment device 80.2) to fitted sheet 20 within fitted sheet center section of fourth side rectangular panel 24.4 and/or foot end FE of top section 22 of fitted sheet 20 and flat sheet center section 38 to secure or hold in place flat sheet 30 thereto fitted sheet 20 at the foot of the bed.

It is recognized herein that connection system 80.1 may be positioned anywhere on fourth side rectangular panel 24.4 or top section 22, and preferably therein center section 28 of foot end FE about a centerline CL. Connection system 80.1 may include where flat sheet 30 edge of fourth edge panel 34.4 may be connected, attach, affixed, or sewn S (attachment device 80.2) to fitted sheet 20 edge of fourth side rectangular panel 24.4.

It is recognized herein that grommets 50 may be secured to fitted sheet 20, flat sheet 30, and blanket 30A, or the like by heat bonded fusible interlacing or the like to prevent grommets 50 from tearing or separating from fitted sheet 20, flat sheet 30, and blanket 30A.

In use, first sleeper S1 lying on fitted sheet 20 between fitted sheet 20 and flat sheet 30 on one side of centerline CL and second sleeper S2 lying on fitted sheet 20 between fitted sheet 20 and flat sheet 30 on other side of centerline CL. If either first sleeper S1 or second sleeper S2 does a tuck and roll or hook a knee or elbow to steal fitted sheet 20 and blanket 30A and force the other to wake up coverless and cold, bedlinens 10 having connection system 80 to secure or hold in place flat sheet 30 and blanket 30A thereto fitted sheet 20 at the foot of the bed to prevent either first sleeper S1 or second sleeper S2 from performing a tuck and roll or hook a knee or elbow and de-sheet and de-blanket the other while sleeping, and thus stealing fitted sheet 20 and blanket 30A and force the other to wake up coverless and cold.

It is recognized herein that connection system 80 prevents the non-puller or non-tugger from being de-sheeted and/or de-blanketed while sleeping.

It is further recognized herein that connection system 80 may be configured to make it easier to make the bed in the morning, since flat sheet 30 is affixed to fitted sheet 20 both stay in place throughout the night.

With respect to the above description then, it is to be realized that the optimum dimensional relationships, to include variations in size, materials, shape, form, position, function and manner of operation, assembly and use, are intended to be encompassed by the present disclosure.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Moreover, the present disclosure has been described in detail, it should be understood that various changes, substitutions and alterations can be made thereto without departing from the spirit and scope of the disclosure as defined by the appended claims. Accordingly, the present disclosure is not limited to the specific embodiments illustrated herein but is limited only by the following claims.

The invention claimed is:

1. A bedlinen connection system for a mattress with a centerline, a foot end, and an upper edge, said system comprising:

a fitted sheet to fit the mattress, said fitted sheet having a fitted sheet center section of a foot end panel centered proximate the centerline, said fitted sheet center section configured having two or more straps, each of said two or more straps having one end portion affixed to said foot end panel and an other end portion extends vertically above a perimeter edge of said fitted sheet corresponding to the upper edge of the mattress; and a flat sheet to lay on said fitted sheet having a flat sheet center section of a foot edge panel centered proximate the centerline, said flat sheet center section configured having two or more flat sheet grommets positioned above a flat sheet bend of said flat sheet corresponding to the upper edge of the mattress, each of said two or more flat sheet grommets to receive said other end of one of said two or more straps to connect said flat sheet to said fitted sheet.

2. The system of claim 1, further comprising two or more cinch devices, each said two or more cinch devices configured to hold each of said two or more flat sheet grommets to each of said two or more straps.

3. The system of claim 2, wherein said two or more cinch devices, said two or more flat sheet grommets, and said two or more straps to hold in place said flat sheet to said fitted sheet at the foot end.

4. The system of claim 2, further comprising two or more washers, each of said two or more washers configured to hold in place said flat sheet to said fitted sheet.

5. The system of claim 1, wherein said two or more flat sheet grommets are positioned above said other end of said two or more straps.

6. The system of claim 1, further comprising a first foot exit and second foot exit of said flat sheet, said first foot exit extends from one side of said flat sheet center section and second foot exit extends from a other side of said flat sheet center section to enable a user's foot to escape from under said flat sheet.

7. The system of claim 1, further comprising a blanket to lay on said flat sheet having blanket center section of a foot edge panel centered proximate the centerline, said blanket center section configured having two or more blanket grommets positioned above a blanket bend of said blanket, each of said two or more blanket grommets to receive said other end of one of said two or more straps to hold in place said blanket and said flat sheet to said fitted sheet at the foot end.

8. The system of claim 7, wherein said two or more blanket grommets are positioned above said two or more flat sheet grommets.

9. The system of claim 1, wherein said two or more straps are positioned side-by-side in parallel about the centerline.

10. A bedlinen connection system for a mattress with a centerline, a foot end, and an upper edge, said system comprising:

a fitted sheet to fit the mattress having a fitted sheet center section of a foot end panel centered proximate the centerline, said fitted sheet center section having two or more fitted sheet grommets positioned above a perimeter edge of said fitted sheet corresponding to the upper edge of the mattress;

a flat sheet to lay on said fitted sheet having a flat sheet center section of a foot edge panel centered proximate the centerline, said flat sheet center section configured having two or more flat sheet grommets positioned above a flat sheet bend of said flat sheet corresponding to the upper edge of the mattress; and two or more straps, each of said two or more straps having one end portion configured having a stop device and a other end portion extends through one of said two or more fitted sheet grommets and extends through one of said two or more flat sheet grommets to connect said flat sheet to said fitted sheet.

11. The system of claim 10, further comprising two or more cinch devices, each said two or more cinch devices configured to hold each of said two or more flat sheet grommets and said two or more fitted sheet grommets to each of said two or more straps.

12. The system of claim 10, further comprising a blanket to lay on said flat sheet having blanket center section of a foot edge panel centered proximate the centerline, said blanket center section configured having two or more blanket grommets positioned above a blanket bend of said blanket, each of said two or more blanket grommets to receive said other end of one of said two or more straps to hold in place said blanket and said flat sheet to said fitted sheet at the foot end.

13. The system of claim 10, wherein said stop device is configured with each of said two or more straps affixed to the foot end of the mattress and centered proximate the centerline.

14. The system of claim 11, further comprising two or more washers, each of said two or more washers configured to hold in place said flat sheet to said fitted sheet.

15. The system of claim 10, wherein said two or more flat sheet grommets are positioned above said two or more fitted sheet grommets.

16. The system of claim 10, further comprising a first foot exit and second foot exit of said flat sheet, said first foot exit extends from one side of said flat sheet center section and second foot exit extends from a other side of said flat sheet center section to enable a user's foot to escape from under said flat sheet.

17. The system of claim 12, wherein said two or more blanket grommets are positioned above said two or more flat sheet grommets.

18. The system of claim 10, wherein said two or more straps are positioned side-by-side in parallel about the centerline.

* * * * *